United States Patent [19]

Aichinger et al.

[11] 4,095,109

[45] June 13, 1978

[54] RADIATION DETECTOR FOR AN AUTOMATIC X-RAY EXPOSURE TIMER

[75] Inventors: Horst Aichinger, Fuerth; Hans Ebersberger, Nuremberg, both of Germany

[73] Assignee: Siemens Aktiengesellschaft, Berlin & Munich, Germany

[21] Appl. No.: 773,500

[22] Filed: Mar. 2, 1977

[30] Foreign Application Priority Data

Mar. 15, 1976 Germany ..... 2610875

[51] Int. Cl.[2] ..... H05G 1/44; H01J 39/28

[52] U.S. Cl. ..... 250/374; 250/322; 250/355

[58] Field of Search ..... 250/322, 354, 355, 315 A, 250/374

[56] References Cited

U.S. PATENT DOCUMENTS

| | | | |
|---|---|---|---|
| 2,825,816 | 3/1958 | Rogers | 250/355 |
| 3,679,902 | 7/1972 | Hurst et al. | 250/355 |
| 3,988,584 | 10/1976 | Lange et al. | 250/315 A |

FOREIGN PATENT DOCUMENTS

| | | | |
|---|---|---|---|
| 225,811 | 7/1962 | Austria | 250/374 |

*Primary Examiner*—Alfred E. Smith
*Assistant Examiner*—T. N. Grigsby
*Attorney, Agent, or Firm*—Hill, Gross, Simpson, Van Santen, Steadman, Chiara & Simpson

[57] ABSTRACT

In an illustrated embodiment a radiation detector is to be arranged in front of a xeroradiographic cassette and yet to avoid adverse effects on the xerographic image. To achieve this the shielding layer for the cassette is a graphite layer and the electrode layer consists of a vacuum-deposited electrically conductive material having a low atomic number. Desirably the electrode layer has marginal zones which continuously decrease in thickness so that no sharp absorption contours are present which would be over-accentuated in xerographic image production. Because of the utilization of a graphite layer as a protective shield, the absorption of the radiation detector can be kept very small. Electrical contact with the vacuum deposited electrode layer may be by means of a graphite layer which is in electrical contact with the electrode layer.

5 Claims, 3 Drawing Figures

RADIATION DETECTOR FOR AN AUTOMATIC X-RAY EXPOSURE TIMER

BACKGROUND OF THE INVENTION

The invention relates to a radiation detector for an automatic x-ray exposure timer composed of two walls made of synthetic material fixed at a distance from one another, and each of which is covered with a shielding layer on its exterior side and with an electrode layer on the side facing the other wall.

It is an obvious procedure to arrange a radiation detector of this type in front of an x-ray film, viewed in the direction of radiation. In conjunction with an electric circuit arrangement, this radiation detector forms a signal which is proportional to the radiation dose. The x-ray tube is switched off when this signal and thus the radiation dose reaches a specific value.

In order to produce x-ray photographs, not only x-ray films are used, but in the field known as xeroradiography, altogether conventional paper sheets are also employed. Xeroradiography has been proven successful particularly in the production of mammograms, or photographs of extremeties. A photographic cassette with an electro-photographic exposure layer is here introduced in a support mounting behind the photographic subject. Upon irradiation with x-rays, the exposure layer becomes electrically conductive, thereby serving the production of x-ray images. An arrangement for the electro-photographic exposure of radiographs is known, for example, from the article "Xeroradiography" by J. W. Boag in *Phys. Med. Biol.* volume 18 (1973), number 1, pages 5 through 37, particularly page 25.

In order to automatically control the exposure of a xeroradiographic device, the known radiation detectors can be arranged only behind the photographic cassette, since in xerographic image production, the contours of the edges are over-accentuated, and the known radiation detectors would produce shadows on the photographic exposures. However, the arrangement of a radiation detector behind the photographic cassette is not a satisfactory solution in xeroradiography, since the transmitted radiation transmitted by such a cassette and still available for measurement by the detector is very low. A xeroradiographic cassette, namely, absorbs more than 80% of the radiation, and in unfavorable instances, up to 99%. As a consequence, the cassette-transmitted dose available for sensing and control of the automatic exposure timer is to a considerable extent dependent upon the electric potential utilized in the particular exposure and the thickness of the particular subject. These difficulties can be avoided if the dose impinging upon the cassette is measured by a radiation detector arranged in front of the cassette.

SUMMARY OF THE INVENTION

The object which is the basis of the invention consists in developing a radiation detector for an automatic x-ray exposure timer of the type initially cited such that, in conjunction with a xeroradiography arrangement, it may be employed in front of the xeroradiographic cassette without producing undesired shadow images on the x-ray image to be recorded. In addition, the detector is to absorb the x-radiation as little as possible.

In accordance with the invention, this problem is solved in that the shielding layer is a graphite layer and in that the electrode layer is composed of an electrically conductive, vapor-deposited material. Expediently, the electrode layer is constructed so as to have a continuous decrease in thickness in its marginal zone, so that no sharp absorption contours occur. In this manner, an essentially shadow-free radiation detector is formed. On account of the utilization of a graphite layer as a protective shield, the absorption of the radiation detector can be kept very small.

Other objects, features and advantages of the present invention will be apparent from the following detailed description taken into connection with the accompanying drawings.

DETAILED DESCRIPTION OF THE PREFERRED EMBODIMENT

Figure 1:
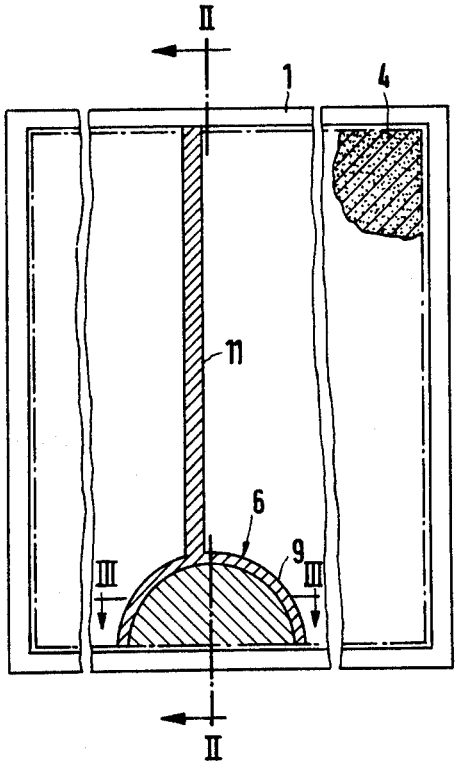
FIG. 1 is a somewhat diagrammatic fragmentary plan view of a radiation detector in accordance with the invention, partly broken away and in section.

The illustrated radiation detector is composed of two walls 2 and 3 made of synthetic material, which are fixed at a distance from one another by means of frame 1 of synthetic material. Walls 2 and 3 of synthetic material are each covered with a graphite layer on their exterior side, for example a graphite lacquer. These layers 4 and 5 of graphite form the protective shield of the detector. In measuring field 6 of the radiation detector, aluminum electrodes 7 and 8 are vapor-deposited on the facing sides of walls 2 and 3. The thickness of electrodes 7 and 8 is approximately 1 micron (1 μm). A vapor-deposition such as this makes it possible to achieve a sufficient sensitivity of the detector. The edges of electrodes 7 and 8 do not have a sharply defined construction but on the contrary are constructed so as to gradually diminish in size; that is the thickness of the vapor-deposited aluminum layer decreases continuously in the marginal zone, so that no sharp absorption contours can occur. The detector is therefore absolutely or essentially shadow-free. For the purpose of signal acceptance from electrodes 7 and 8, graphite layers 9 and 10, are applied between each of these electrodes and the corresponding wall and are in electrical contact with said electrodes. In FIG. 1, band 11 of graphite layer 9 is visible.

It is within the framework of the invention to also use as the electrode material, instead of aluminum, a different electrically conductive material with a low atomic number; for example, graphite.

A low degree of absorption of the detector is achieved through the use of graphite layers 4 and 5 as an electric shield. Equivalent values are obtained which are smaller than 0.12 millimeter (0.12 mm) aluminum at 30 kilovolts (30 kV) in the zone of the measuring field.

Figure 2:
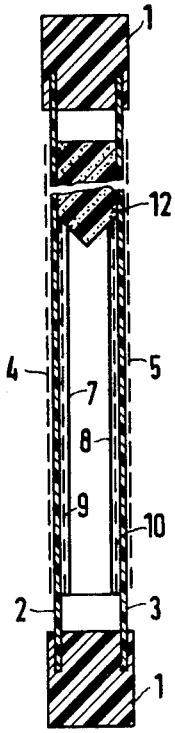
FIG. 2 shows a transverse sectional view taken generally along the line II—II in FIG. 1 and showing the cross section of the detector on an enlarged scale.

The space between walls 2 and 3, outside of the measuring field 6, is filled with a foam material 12, which continuously decreases in thickness at the edge of the measuring field 6 in order to avoid shadow formation (FIG. 2).

It is also possible within the framework of the invention to provide several measuring fields between the two synthetic walls 2 and 3, that is, to provide several electrode layers per synthetic wall, and to select one particular measuring field for a photograph in each instance. Particularly when the radiation detector is employed for mammograms, one of the measuring fields can be turned on for the medio-lateral photograph, and a second measuring field can be switched on for the cranio-caudal photograph, for example. The selective connection of or switching on of one or more of these measuring fields in each instance may also proceed automatically during the adjustment of the x-ray apparatus corresponding to the desired photograph.

Figure 3:
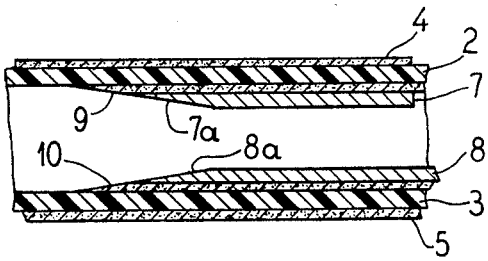
FIG. 3 is a fragmentary somewhat diagrammatic longitudinal sectional view taken generally along the line III—III of FIG. 1.

In FIG. 3, vacuum deposited layers are indicated at 7 and 8 of low atomic numbers such as aluminum. In the marginal zone *7a, 8a,* the vapor-deposited electrode layers continuously decrease in thickness. They are in electrical contact with the respective graphite layers 9 and 10. The electrical signals produced by the impinging radiation are transmitted from the respective electrode layers 7, 8 to the respective bands 11 of graphite. The graphite bands 11 have integral parts of the respective graphite layers 9 and 10 which make electrical contact with respective electrodes. The band 11 and the corresponding band of the graphite layer 10 have a resistance of 5 kOhms between the graphite layer and the edge of the wall 2, 3. It has a width of 10 millimeters. For connection purposes at the ends of the graphite bands soldering lugs are fastened.

It will be apparent that many modifications and variations may be effected without departing from the scope of the novel concepts and teachings of the present invention.

We claim as our invention:

1. A radiation detector for automatic x-ray exposure control comprising two walls of synthetic material fixed at a distance from one another, each of which being covered with a shielding layer on its exterior side and having an electrode layer on the side thereof facing the other wall, characterized in that the shielding layer is a graphite layer, and the electrode layer comprises a vacuum deposited electrically conductive material having a low atomic number.

2. A detector according to claim 1, characterized in that the electrode layer is composed of vacuum deposited aluminum.

3. A detector according to claim 2, characterized in that a graphite layer is supplied between each wall and the electrode layer, said graphite layer being in electrical contact with said electrode layer and extending in the form of a narrow band at the edge of the corresponding wall for the purpose of signal acceptance therefrom.

4. A detector according to claim 1 characterized in that the electrode layer continuously decreases in thickness at its marginal zones.

5. A detector according to claim 1 characterized in that the vacuum deposited electrode layer continuously decreases in thickness at its marginal zones and has a graphite layer in electrical contact therewith, extending in the form of a narrow band to the edge of the corresponding wall for the purpose of signal acceptance therefrom.

* * * * *